US005839036A

United States Patent [19]

Shogren

[11] Patent Number: 5,839,036

[45] Date of Patent: Nov. 17, 1998

[54] MULTISPEED DRIVE MECHANISM

[75] Inventor: David K. Shogren, Ontario, N.Y.

[73] Assignee: Xerox Corporation, Stamford, Conn.

[21] Appl. No.: 876,607

[22] Filed: Jun. 16, 1997

[51] Int. Cl.[6] ..... G03G 15/30

[52] U.S. Cl. ..... 399/213

[58] Field of Search ..... 399/213, 208, 399/209, 196; 74/431

[56] References Cited

U.S. PATENT DOCUMENTS

| | | | |
|---|---|---|---|
| 4,542,983 | 9/1985 | Zambelli et al. . | |
| 4,796,053 | 1/1989 | Nakamura et al. | 399/208 X |
| 4,891,665 | 1/1990 | Mizutani | 399/213 X |
| 5,233,389 | 8/1993 | Deguchi et al. | 399/213 |
| 5,267,002 | 11/1993 | Maitani et al. | 399/213 |

*Primary Examiner*—S. Lee

*Attorney, Agent, or Firm*—Fay, Sharpe, Beall, Fagan, Minnich & McKee

[57] ABSTRACT

The multispeed drive mechanism is a clutchless drive mechanism including a rotatable input shaft and a plurality of input gears of different diameters mounted on the input shaft. A plurality of drive gears of different diameters are rotatably mounted on a support member and each engage one of the plurality of input gears. A driven member is driven at different speeds for the same speed of the input shaft by pivoting the support member about the input shaft and using different input gear/drive gear combinations to provide different gear ratios. The multiple speed drive mechanism is particularly useful for driving the movable platen of a copying apparatus at different speeds for reduction and enlargement copying.

21 Claims, 3 Drawing Sheets

MULTISPEED DRIVE MECHANISM

BACKGROUND OF THE INVENTION

The present invention relates to a multispeed drive mechanism and, more particularly, to a multiple speed gear drive mechanism for use in driving members of a copying apparatus.

The invention is particularly applicable to low speed copying devices and will be described with particular relevance thereto. However, it will be appreciated that the drive mechanism has broader application and may be advantageously employed in other copier and non-copier applications and environments without departing from the invention.

Copying machines generally consist of complex systems which feed paper in, create a permanent image of an original document on the paper, and deliver the finished copy to a document receiving tray. The reproduced image is produced by projecting the image of the original document onto a photoconductive member or photoreceptor. Toner particles are then deposited on the photoreceptor in the areas which correspond to the image of the original document. This toner image is transferred to the paper and fused to the paper by heating the toner particles.

In small, low speed copying machines, the image of the original document is projected onto the photoreceptor by placing the document on a movable platen or glass tray of the copying machine and moving the platen with respect to the photoreceptor to scan the image of the original document onto the photoreceptor. The back and forth motion of the platen is generally provided by a drive system having a clutch. In order to produce a reduced or an enlarged copy of a document, the platen may be moved at different speeds and reduction/enlargement lenses are used. For example, when a reduced size copy is desired, a reduction lens is selected and the platen is moved at a speed which is faster than the standard drive rate used for making same size copies. Alternatively, an enlargement lens is used and the platen is driven at a speed slower than the standard drive rate to achieve a resulting enlarged image of the original document. In known low speed copying machines of this type having a movable platen, the drive speed of the platen is varied by a multiple speed drive mechanism employing a clutch. One such drive mechanism is disclosed in U.S. Pat. No. 4,542,983.

The need for a clutch to achieve these different drive speeds greatly increases the cost of the drive mechanism. Therefore, it would be desirable to provide a simpler, clutchless drive system for driving the movable platen in a low speed copying apparatus.

SUMMARY OF THE INVENTION

The multiple speed drive mechanism according to the preferred embodiment of the invention addresses the disadvantages of known drive systems by providing a clutchless drive mechanism which is simple and economical.

In accordance with the present invention, a multiple speed drive mechanism is provided which includes a rotatable input shaft, a plurality of input gears of different diameters mounted on the input shaft, and a plurality of drive gears of different diameters rotatably mounted on a support member at fixed distances from the input shaft. A driven member is driven at different speeds for the same speed of the rotatable input shaft by pivoting the support member about the input shaft to provide different gear ratios.

Further, in accordance with the invention, a movable platen is driven by the multiple speed drive mechanism at different driven speeds.

Further, in accordance with the invention, the input shaft and the driven member are positioned at a fixed distance apart and the drive gears and input gears are sized such that the drive gears may be selectively positioned directly between the input shaft and the driven member.

A principal advantage of the invention is the ability to drive a driven member at different speeds without the need for an expensive and complicated drive mechanism including a clutch.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, a preferred embodiment and method of which will be described in detail in the following detailed description and illustrated in the accompanying drawings which form a part hereof, and wherein.

DETAILED DESCRIPTION OF THE PREFERRED EMBODIMENT

Figure 1:
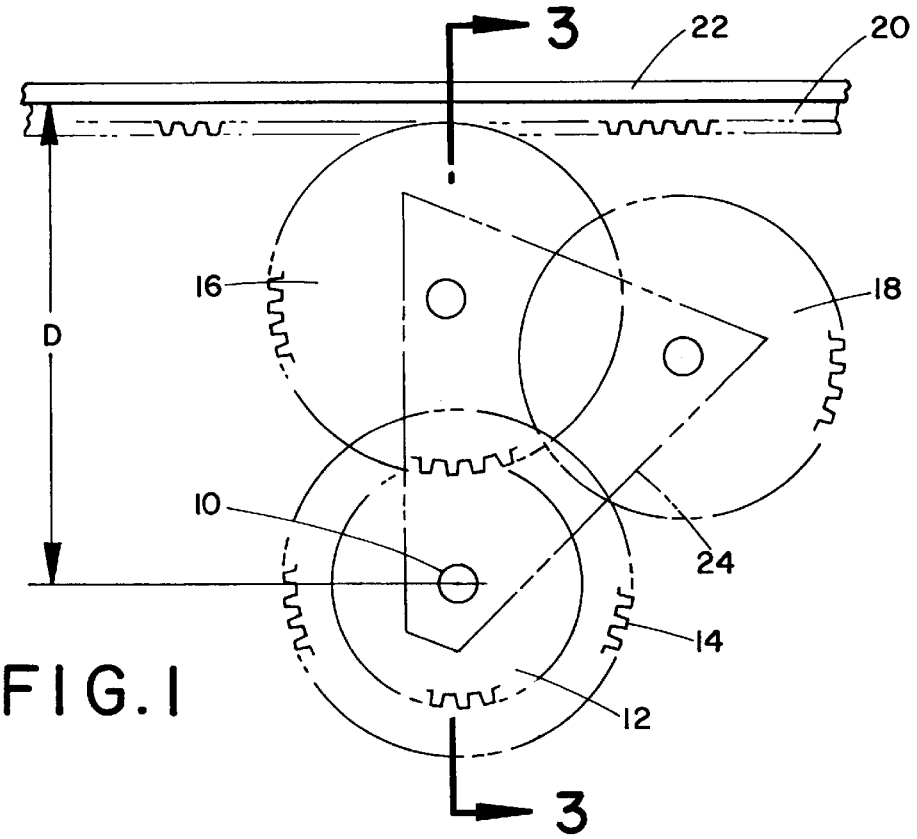
FIG. 1 is a schematic view of the multiple speed drive mechanism according to the present invention in a first position.

Referring now to the drawings wherein the showings are for the purposes of illustrating the preferred embodiment of the invention only and not for purposes of limiting same, the FIGURES illustrate a multiple speed drive mechanism including an input shaft having multiple input gears and multiple drive gears engaging the input gears. Each combination of input and drive gears is arranged to provide a different gear ratio from the input shaft to an output rack, while at the same time maintaining a fixed dimension between the output rack and the input shaft.

The multiple speed drive mechanism shown in FIG. 1 includes a rotatable input shaft 10 and upper and lower input gears 12, 14 mounted on the input shaft for rotation with the input shaft. First and second drive gears 16, 18 selectively transmit the power from the input shaft 10 to a rack 20. The rack 20 is preferably attached to a movable platen 22 of a copying apparatus. The first and second drive gears 16, 18 are rotatably mounted on a support member 24 which is a triangular shaped plate supported either above or below the gears. The support member 24 is rotatable about the input shaft 10 and maintains the first and second drive gears 16, 18 in engagement with the input gears 12, 14 at a fixed distance from the input shaft.

The upper input gear 12 and the first drive gear 16 which together provide a first gear ratio are illustrated in solid lines, while the lower input gear 14 and the second drive gear 18 providing a second gear ratio are illustrated in broken lines.

Figure 3:
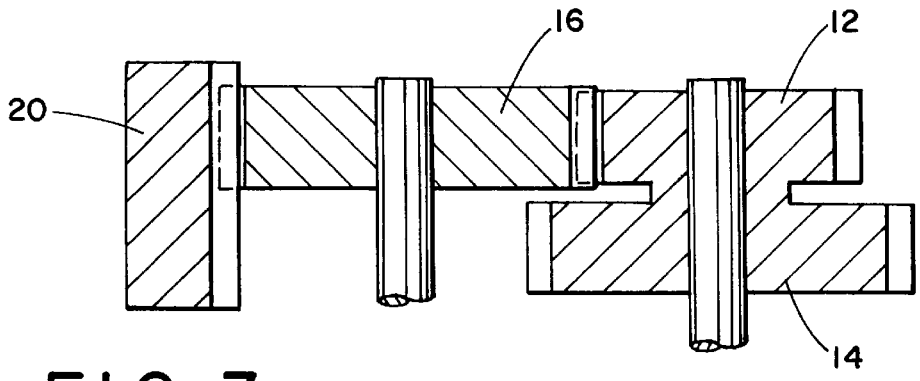
FIG. 3 is a schematic cross-sectional view taken along line 3—3 of FIG. 1.

In the configuration illustrated in FIGS. 1 and 3, the power is transmitted from the input shaft 10 and the upper input gear 12 to the first drive gear 16 and then from the first drive gear to the rack 20. The speed at which the movable platen 22 is moved is determined by the rpm of the input shaft and the number of teeth on the upper input gear 12 and the first drive gear 16. In the embodiment shown in FIG. 1, the first drive gear 16 is larger than the upper input gear 12, however, the relative sizes of the two gears may be varied to achieve different gear ratios.

The gear ratio of the multiple speed drive mechanism is changed by pivoting the support member 24 and the first and second drive gears 16, 18 attached to the support member about the input shaft 10 to bring different drive gears into engagement with the rack 20. Movement of the drive gears 16, 18 around the input shaft 10 is performed by adjusting the support member 24 and locking the support member in place with a locking mechanism.

Figure 5:
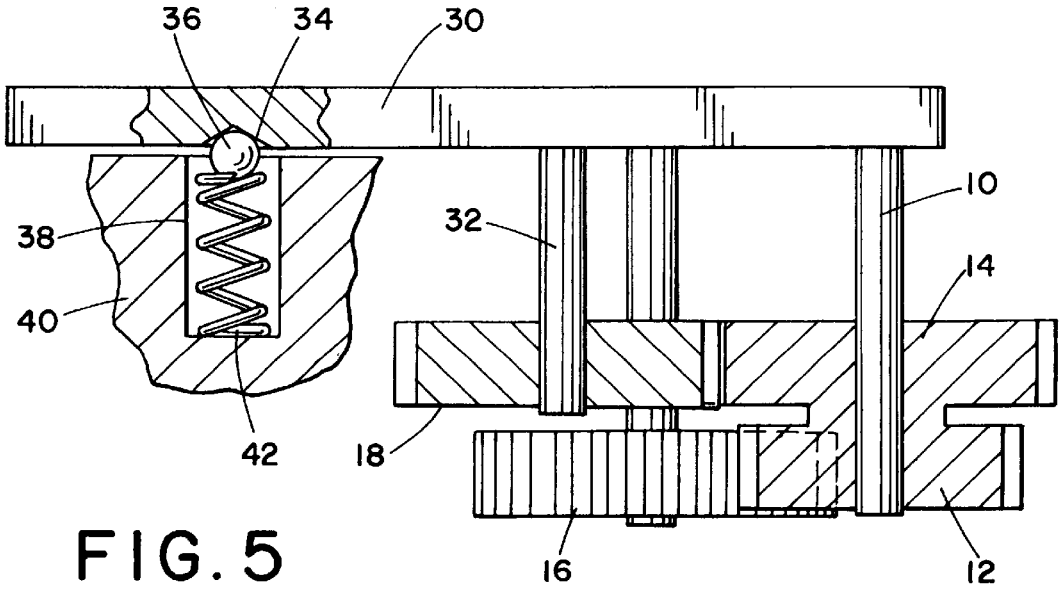
FIG. 5 is a schematic illustration of the locking mechanism according to the present invention.

A simple lever and detent arrangement, shown in FIG. 5, may be used as a locking mechanism to allow movement of the support member 24 from one position to another and to lock the support member in place during use. The locking mechanism includes a shift lever 30 which is mounted either on the support member 24 or on the input shaft 10 and the shaft 32 of one of the drive gears 16. The shift lever 30 includes a detent 34 which receives a ball 36. The ball 36 is supported in a recess 38 in a frame member 40 of the copier structure. The ball 36 is spring biased by a spring 42 in a known manner. Spring biased balls 36 are also located at other locking locations such that the support member 24 can be locked in different positions to achieve different gear ratios.

Figure 2:
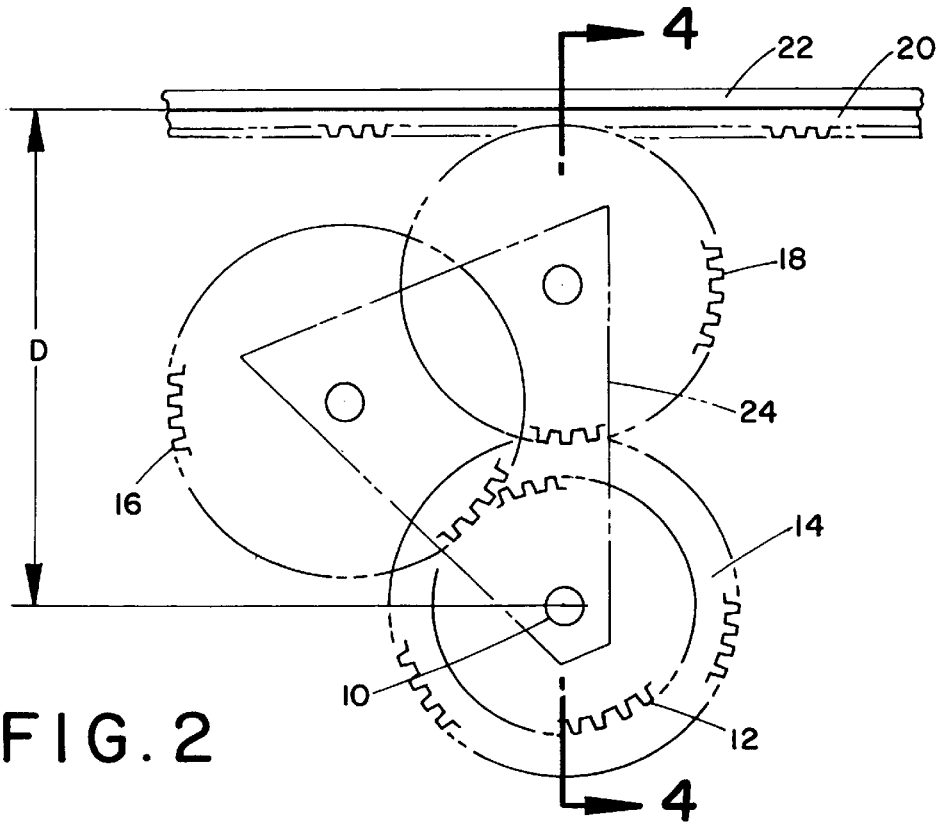
FIG. 2 is a schematic illustration of the multiple speed drive mechanism of FIG. 1 in a second position.

The multiple speed drive mechanism in the position illustrated in FIG. 1 may be used to drive a movable platen 22 at a first drive rate, while the position of the multiple speed drive mechanism may be rotated to the position illustrated in FIG. 2 to drive a movable platen at a second drive rate.

Figure 4:
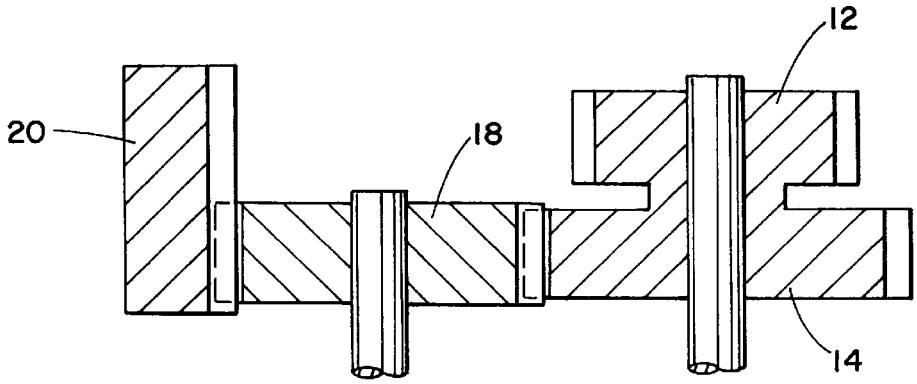
FIG. 4 is a schematic cross-sectional view taken along line 4—4 of FIG. 2.

In FIG. 2, the first drive gear 16 and the entire support device 24 are shifted or rotated to the left and the first drive gear 16 disengages from the platen rack 20. As the support device 22 continues to be shifted to the left, the second drive gear 18 is engaged with the rack 20. Power is transmitted from the lower input gear 14 to the second drive gear 18 and to the rack 20. The position of the drive mechanism illustrated in FIGS. 2 and 4 provides a different gear ratio and a higher rack 20 speed than the rack speed provided by the drive mechanism in the position of FIG. 1 for the same input shaft 10 speed.

Although only two different gear ratios are illustrated in the drawings other gear ratios and rack speeds can be achieved by varying the sizes of the input and drive gears. However, each set of input and drive gears must be sized so that a constant distance D is maintained between an axis of the input shaft 10 and the rack 20. This constant distance D corresponds to approximately ½ the diameter of the input gear plus the diameter of the drive gear for each input gear/drive gear combination. Thus, when a larger drive gear 16, 18 is used, a smaller input gear 12, 14 must be used to maintain a correct constant input shaft 10 to rack 20 distance D.

Figure 6:
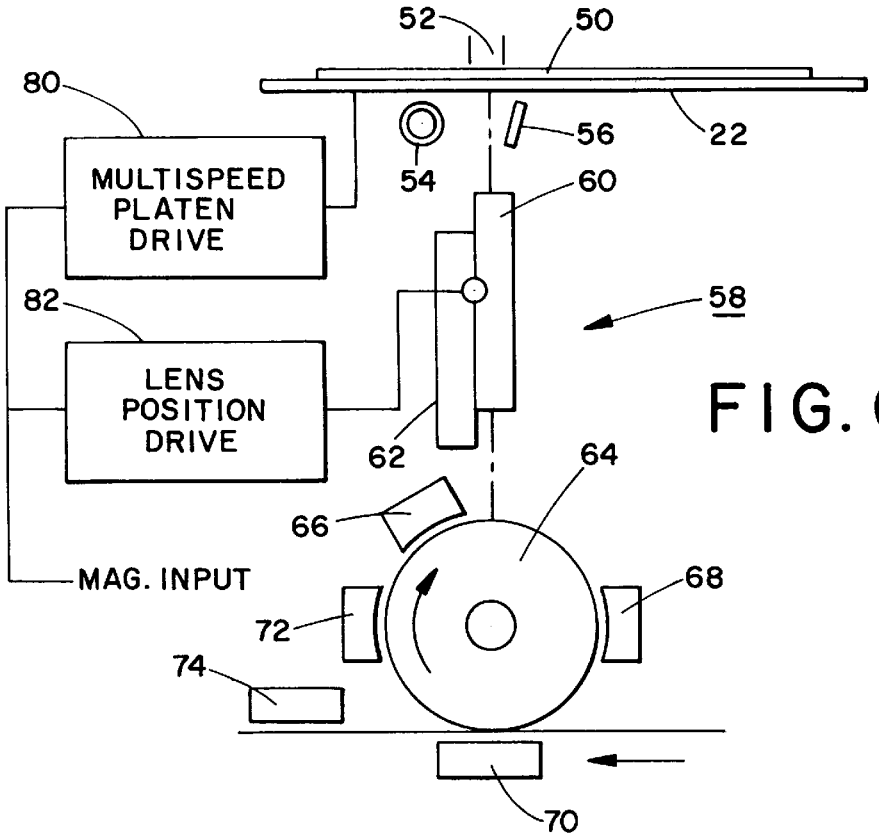
FIG. 6 is a schematic side view of a copying apparatus in which the multiple speed drive mechanism may be used.

A copying apparatus according to the present invention is shown in FIG. 6 for reproducing documents 50 at different magnifications. The document 50 is placed on the movable platen 22 and moved past a narrow illumination strip 52 where light from a lamp 54 is directed to the document via a reflector 56. A linear lens array 58 includes lenses 60, 62 for reproducing the document at different magnifications. The image is transmitted through a selected lens to the surface of a photoconductive drum 64. The imaging system includes a charging station 66, a development station 68, a transfer station 70, a cleaning station 72, and a fusing station 74. The processes performed at each of these xerographic stations are well known in the art.

In operation, a magnification is selected by an operator at an input panel and the multispeed platen drive 80 and lens position drive 82 move the appropriate lens 60, 62 and gears 16, 18 into position for the desired magnification. The movable platen 22 is then moved by the multispeed drive mechanism illustrated in FIGS. 1–4 at a desired speed for the selected magnification.

In a copying apparatus in which the rack 20 is attached to a platen 22, the increase in the speed of the platen with a gear ratio such as that shown in FIG. 2 is used in combination with a reduction lens for reduced size copying. The optical reduction of the copying apparatus requires that the speed of the platen be increased by the reciprocal of a desired reduction ratio.

Additional gear ratios can be easily added to the configuration of the multiple speed drive mechanism illustrated in the FIGURES by arranging additional input gears and drive gears concentrically around the input shaft 10. These additional gear combinations will be sized to maintain the constant dimension D between the rack 20 and the input shaft 10.

Figure 7:
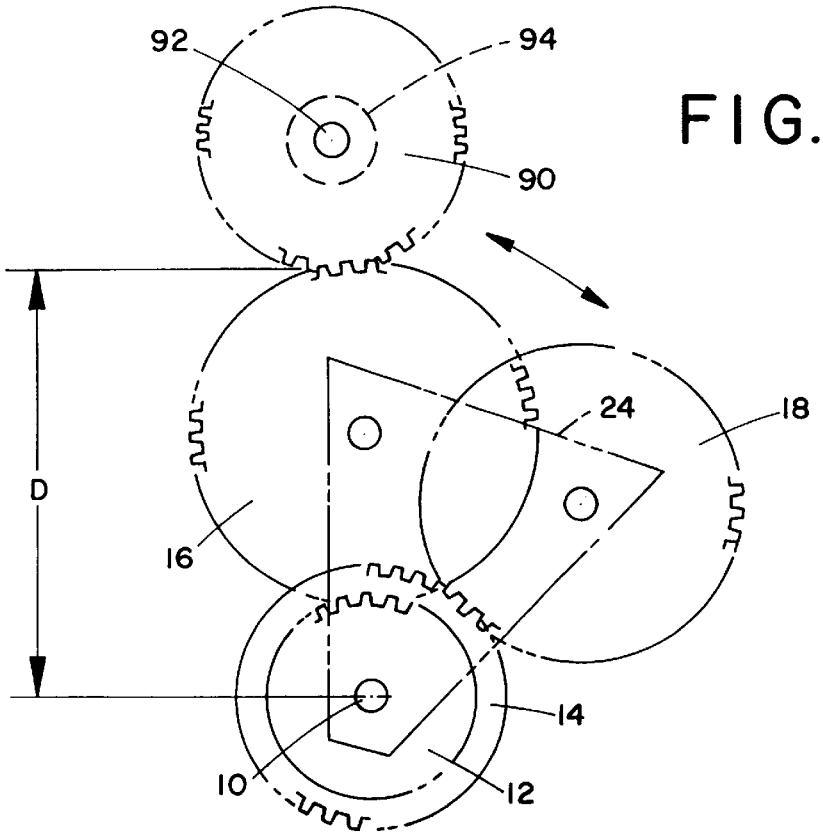
FIG. 7 is a schematic view of a multiple speed drive mechanism with a circular gear output member.

Although the invention has been illustrated with a rack 20 as an output member, a fixed axis circular gear could be substituted for the rack without departing from the invention. FIG. 7 illustrates such an arrangement with a fixed axis circular output gear 90 positioned for engagement with one of the drive gears 16, 18. An output shaft 92 of the output gear 90 may be connected to one of many different driven members of a printing apparatus which is to be driven at different speeds. The multiple speed drive mechanism of FIG. 7 is operated in the same manner as the drive mechanism of FIGS. 1 and 2 by rotating the support device 24 about the input shaft 10.

The invention has been described for use in low speed copiers to move a movable platen at different speeds for standard same size copying, enlargement copying, and reduction copying. However, the drive mechanism may also be used in other systems within the copying machine. For example, the multiple speed drive mechanism may be used to drive a shuttle mechanism for offset stacking of copies in a stacking tray by connection of the rack 20 to the shuttle mechanism. The multiple speed drive mechanism may also be used in a stacker to drive sheets of paper of different lengths into the sheet receiving tray of a printing apparatus in the same time interval. This is achieved by increasing the sheet delivery speed for larger size sheets and decreasing the sheet delivery speed for smaller size sheets. The sheet speed is adjusted by connecting the output shaft 92 to a variable speed feed roller 94.

In addition, the drive mechanism may be used to drive an inverter mechanism for double-sided copying. The inverter may be operated at different speeds to accommodate different size sheets in the same time interval in the same manner as the stacker by connecting the output shaft 92 to a variable speed feed roller 94.

Further, by using the circular output gear 90, a convenient speed change can be performed in a conventional optical scanning system with a fixed platen. In this system, the scanning speed can be adjusted by connecting the multiple speed drive mechanism to a variable speed sheet feeding member to achieve standard size, enlargement, and reduction copying.

Another application where a speed change is used in a printing apparatus is with a roll fuser. Depending on the type of copy media use, it is desirable to change the amount of fusing time. The fusing time can be changed by changing the speed with which the sheets are fed through the fuser. In this application, the output shaft 92 of the circular output gear 90 is used to drive a feed roller 94 at a variable speed to feed the sheets through the fuser. The drive mechanism may also be advantageously employed in non-copier environments.

FIG. 5 illustrates a simple shift lever 30 for shifting between respective drive gears 16, 18 of the multispeed drive mechanism, this shift lever may be actuated either manually or automatically. Where automatic position shift of the shift lever 30 is desirable, the shift lever 30 may be connected to a solenoid so that the shift lever is actuated according to an electronic control algorithm of the printing apparatus. The shift lever 30 may also be actuated by interconnection to a related function of the printing apparatus such as a paper size selection mechanism. With this arrangement, for example, adjustment of the paper size may also adjust the multispeed drive mechanism to change a speed of a feed roller of the paper stacker simultaneously with the paper size adjustment.

While the invention has been described in detail with reference to a preferred embodiment thereof, it will be apparent to one skilled in the art that various changes and modifications can be made, and equivalents employed, without departing from the scope of the invention as set forth in the appended claims.

Having thus described the invention, it is claimed:

1. Copying apparatus comprising:

a movable platen for receiving original documents to be copied;

an imaging apparatus for imaging the original documents positioned on the platen;

a multiple speed gear drive mechanism for moving the movable platen with respect to the imaging apparatus, the multiple speed gear drive mechanism including an input shaft, a plurality of input gears mounted on the input shaft, a plurality of drive gears, each of the drive gears engaging one of the input gears on the input shaft and selectively engaging and driving a drive member for driving the platen, wherein the drive gears are supported on a support structure which is pivoted about the input shaft to change a gear ratio of the drive mechanism.

2. The copying apparatus of claim 1, wherein the drive member for driving the platen comprises a rack attached to the platen and engageable by one of the plurality of drive gears at a time.

3. The copying apparatus of claim 2, wherein the input shaft and the rack are positioned at a fixed distance apart and the drive gears and input gears are sized such that the drive gears may be selectively positioned directly between the input shaft and the rack.

4. The copying apparatus of claim 1, wherein the drive gears are rotatably mounted on the support structure at a fixed distance from the input shaft.

5. The copying apparatus of claim 1, wherein a first of the plurality of drive gears drives the platen at a speed which results in same size copying and a second of the plurality of drive gears drives the platen at a speed which results in reduced size copying.

6. The copying apparatus of claim 1, wherein each of the plurality of drive gears is in continuous engagement with a corresponding one of the plurality of input gears.

7. The copying apparatus of claim 1, wherein the multiple speed gear drive mechanism drives the platen at a standard drive rate for same size copying, at a reduced drive rate for enlargement copying, and at an increased drive rate for reduction copying.

8. The copying apparatus of claim 1, wherein the multiple speed gear drive mechanism is a clutchless drive mechanism.

9. A printing apparatus comprising:

a driven member;

a multiple speed drive mechanism for driving the driven member including an input shaft, first and second input gears mounted on the input shaft, first and second drive gears, the first drive gear engaging the first input gear and the second drive gear engaging the second input gear, and a positioning device for selectively positioning one of the first and second drive gears in an engagement position in which the one of the first and second drive gears drives the driven member.

10. The printing apparatus of claim 9, wherein the printing apparatus is a copying machine and the driven member is a movable platen.

11. The printing apparatus of claim 9, wherein the driven member is an inverter for inverting sheets transported through the printing apparatus.

12. The printing apparatus of claim 9, wherein the driven member is a shuttle mechanism for an offset stacking assembly.

13. The printing apparatus of claim 9, wherein the driven member is a sheet feeding roller.

14. The printing apparatus of claim 9, wherein the first and second drive gears are rotatably mounted on a support member at fixed distances from the input shaft and wherein the support member is rotatable about the input shaft to select a desired gear ratio.

15. The printing apparatus of claim 9, wherein the input shaft and the driven member are positioned at a fixed distance apart.

16. The printing apparatus of claim 9, wherein the multiple speed drive mechanism is a clutchless drive mechanism.

17. A multiple speed drive mechanism comprising:

a rotatable input shaft;

first and second input gears of different diameters mounted on the input shaft;

a support member rotatable about an axis of the input shaft;

first and second drive gears of different diameters rotatably mounted on the support member at fixed distances from the input shaft, the first drive gear engaging the first input gear and the second drive gear engaging the second input gear; and a driven member which is driven at different speeds for an input speed of the input shaft by pivoting the support member about the input shaft to provide different gear ratios.

18. The multiple speed drive mechanism of claim 17, further comprising a locking mechanism for locking the support member in a plurality of different positions to provide different gear ratios.

19. The multiple speed drive mechanism of claim 17, wherein the first and second input gears are in continuous engagement with the first and second drive gears.

20. The multiple speed drive mechanism of claim 17, wherein the input shaft and the driven member are positioned at a fixed distance apart.

21. The multiple speed drive mechanism of claim 17, wherein the multiple speed drive mechanism is a clutchless drive mechanism.

* * * * *